US009850016B2

(12) United States Patent
Curles

(10) Patent No.: US 9,850,016 B2
(45) Date of Patent: Dec. 26, 2017

(54) ROUND COTTON MODULE OPENER

(71) Applicant: CTC Design, Inc., Cordele, GA (US)

(72) Inventor: Curtis Thomas Curles, Cordele, GA (US)

(73) Assignee: CTC Design, Inc., Cordele, GA (US)

( * ) Notice: Subject to any disclaimer, the term of this patent is extended or adjusted under 35 U.S.C. 154(b) by 80 days.

(21) Appl. No.: 14/568,297

(22) Filed: Dec. 12, 2014

(65) Prior Publication Data

US 2015/0166209 A1 Jun. 18, 2015

Related U.S. Application Data

(60) Provisional application No. 61/915,748, filed on Dec. 13, 2013, provisional application No. 61/935,635, filed on Feb. 4, 2014.

(51) Int. Cl.
*B65B 61/08* (2006.01)
*B65B 69/00* (2006.01)

(52) U.S. Cl.
CPC ..... *B65B 69/0033* (2013.01)

(58) Field of Classification Search
CPC . B65B 69/0033; B65B 69/00; B65B 69/0008; D01G 7/08; D01G 7/00
USPC ..... 53/381.2
See application file for complete search history.

(56) References Cited

U.S. PATENT DOCUMENTS 3,500,693 A * 3/1970 Wright ..... B65G 13/071 474/114
3,897,018 A * 7/1975 Wilkes ..... B65B 69/00 19/80 R
4,610,596 A * 9/1986 Bouldin ..... B65B 69/0033 30/140
4,789,289 A * 12/1988 Wilson ..... A01D 87/127 241/101.76
4,929,141 A * 5/1990 Keesey ..... B65B 69/0033 414/412
5,318,399 A * 6/1994 Marom ..... B65B 69/00 414/412
5,454,683 A * 10/1995 Marom ..... B65B 69/0033 29/564.3
5,556,041 A * 9/1996 Cheesman ..... A01F 29/005 241/200
5,813,199 A * 9/1998 Temburg ..... D01G 7/06 414/412

(Continued)

*Primary Examiner* — Anna Momper
*Assistant Examiner* — Mark Hageman
(74) *Attorney, Agent, or Firm* — Nelson Mullins Riley & Scarborough LLP

(57) ABSTRACT

A round module opener for use with a round module of cotton disposed within a wrap, including a frame, an unload conveyor assembly that is supported by the frame and moves the round module of cotton in a first direction that is parallel to a longitudinal center axis of the round module opener, a slitter assembly that is secured to the frame and slices through the wrap along its entire length as the round module of cotton moves in the first direction, and a picker assembly including a plurality of projections, the picker assembly being rotatable so that the plurality of projections first pierce a first portion of the wrap and are subsequently withdrawn from the first portion of the wrap, thereby separating the first portion of the wrap from the round cotton module.

14 Claims, 8 Drawing Sheets

(56) References Cited

U.S. PATENT DOCUMENTS

| | | | | |
|---|---|---|---|---|
| 8,091,816 | B2 * | 1/2012 | Curles | A01F 29/005<br>241/200 |
| 8,251,229 | B2 * | 8/2012 | Stover | B65B 69/0033<br>209/616 |
| 8,800,114 | B2 * | 8/2014 | Brown | B65B 69/0033<br>19/64.5 |
| 2009/0297309 | A1 * | 12/2009 | Stover | B60P 1/38<br>414/491 |

* cited by examiner

ROUND COTTON MODULE OPENER

CLAIM OF PRIORITY

This application claims priority to U.S. Provisional Patent Application Ser. Nos. 61/915,748, filed Dec. 13, 2013, and 61/935,635, filed Feb. 4, 2014, the entire disclosures of which are hereby incorporated by reference herein.

TECHNICAL FIELD

The present invention relates generally to a device for removing a wrap from a bale of a fibrous substance. More particularly, the present invention relates to a device for removing a wrap from a cylindrically-shaped cotton module.

BACKGROUND

Some recently developed cotton pickers roll and wrap cotton into a cylindrically-shaped module, hereafter referred to as a "round module," as shown in FIGS. 1A and 1B. This is done inside the picking machine as the cotton is picked in the field. One such picking machine is the CP690 Cotton Picker manufactured by Deere & Company, Moline, Ill., 61265. A typical round cotton module 10 can measure 7 to 8 feet in diameter, approximately 8 feet in length, and weigh approximately 7,000 pounds. A wrap 20 extends between the end faces 12 of the round module 10 and terminates at a tail 24, covering the cylindrical side surface of the module so as to prevent contamination, wetting and soiling of the cotton when the round module is placed on the ground by the picking machine for retrieval by a truck or other module mover. Typically, the picking machine can store one wrapped round module 10 as it makes another. This enables the farmer to pick cotton for the second module without having to stop so that the previously wrapped round module can be dropped off at the edge of the field. The new cotton pickers eliminate up to three pieces of equipment when compared to previous methods of baling cotton, and the labor to operate them. For example, previous methods of baling cotton typically required a rectangular module builder, a bowl buggy and a tractor. However, even with the noted advantages, many cotton gins are not presently configured to process round modules. Specifically, wraps 20 on the round cotton modules are manually removed by workers, increasing labor costs. As well, it is not uncommon for portions of the wraps to be inadvertently left on the round modules, meaning that portions of the plastic wraps can enter the cotton gin, thereby contaminating the cotton.

Currently, feeders for cotton gins are supplied in three basic types: roller bed, moving chain and walking floor. Typical roller bed and moving chain type feeders have beds that are 60 to 80 feet in length. The beds are often divided into three sections so that modules can be loaded on one end and caught up to any previously loaded modules. Sections of the bed are simply turned on and off as needed to butt modules end to end before entering the dispersing head of the cotton gin, which is located at the opposite end of the feeder bed from where the bales are loaded. The walking floor type of feeder does not have the ability to catch-up modules, therefore trucks must unload modules by backing onto the moving floor. Trucks must butt modules together during the unloading for efficient ginning Preferably, wraps 20 would be recovered from the round modules 10 prior to the modules being placed on the feeder bed for the gin.

The present invention recognizes and addresses considerations of prior art constructions and methods.

SUMMARY OF THE INVENTION

An embodiment of the present invention provides a round module opener for use with a round module of cotton that is disposed within a wrap, the round module opener including a frame, an unload conveyor assembly that is rotatably supported by the frame so that rotation of the unload conveyor assembly moves the round module of cotton in a first direction from a first end to a second end of the round module opener, the first direction being parallel to a longitudinal center axis of the round module opener, a slitter assembly that is secured to the frame and positionable so that the slitter assembly slices through the wrap along its entire length as the round module of cotton moves from the first end to the second end of the round module opener, and a picker assembly including a plurality of projections, the picker assembly being adjacent the unload conveyor assembly and rotated relative to the frame so that the plurality of projections first pierce a first portion of the wrap and are subsequently withdrawn from the first portion of the wrap, thereby separating the first portion of the wrap from the round cotton module.

Another embodiment of the present invention provides a round module opener for use with a round module of cotton that is disposed within a wrap, the round module opener including a frame, an unload conveyor assembly that is rotatably supported by the frame so that rotation of the unload conveyor assembly moves the round module of cotton in a first direction from a first end to a second end of the round module opener, the first direction being parallel to a longitudinal center axis of the round module opener, a slitter assembly that is secured to the frame and positionable so that the slitter assembly slices through the wrap along its entire length as the round module of cotton moves from the first end to the second end of the round module opener, and a picker assembly that is adjacent the unload conveyor assembly on a downstream side of the slitter assembly so that the picker assembly engages a first portion of the wrap and separates the first portion of the wrap from the round cotton module.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1A:
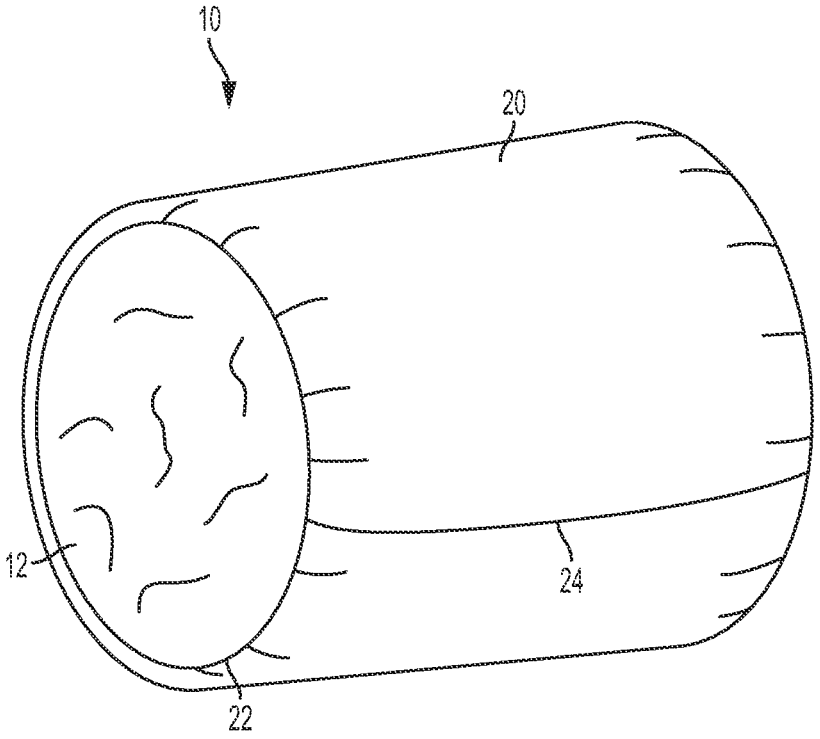
FIGS. 1A and 1B are perspective and end views of a round cotton module.

Repeat use of reference characters in the present specification and drawings is intended to represent same or analogous features or elements of the invention according to the disclosure.

DETAILED DESCRIPTION

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 1B:
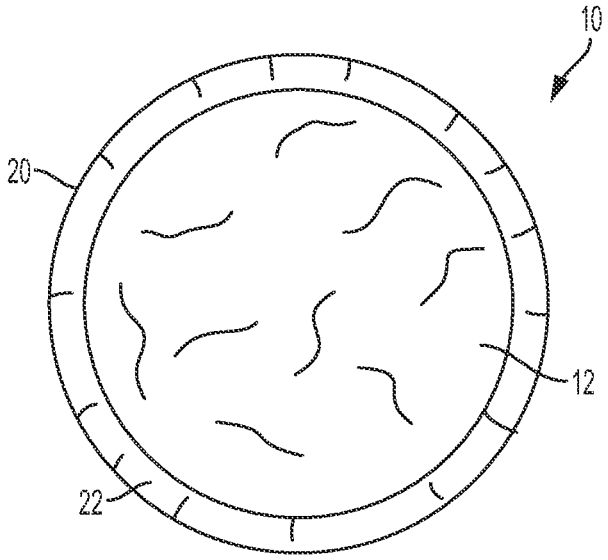
Figure 2:
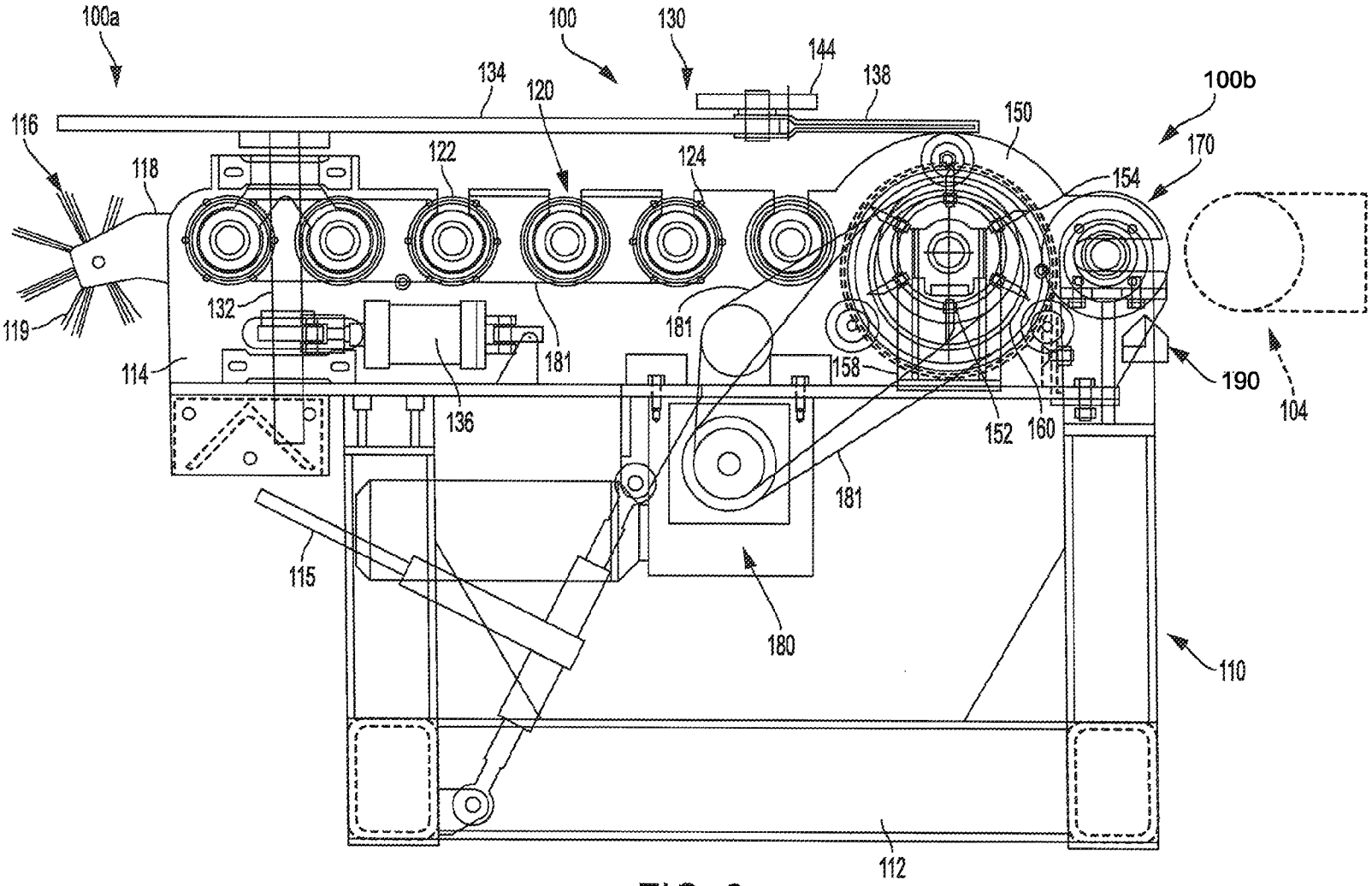
FIG. 2 is a side view of a round cotton module opener in accordance with an embodiment of the present disclosure.
Figure 3:
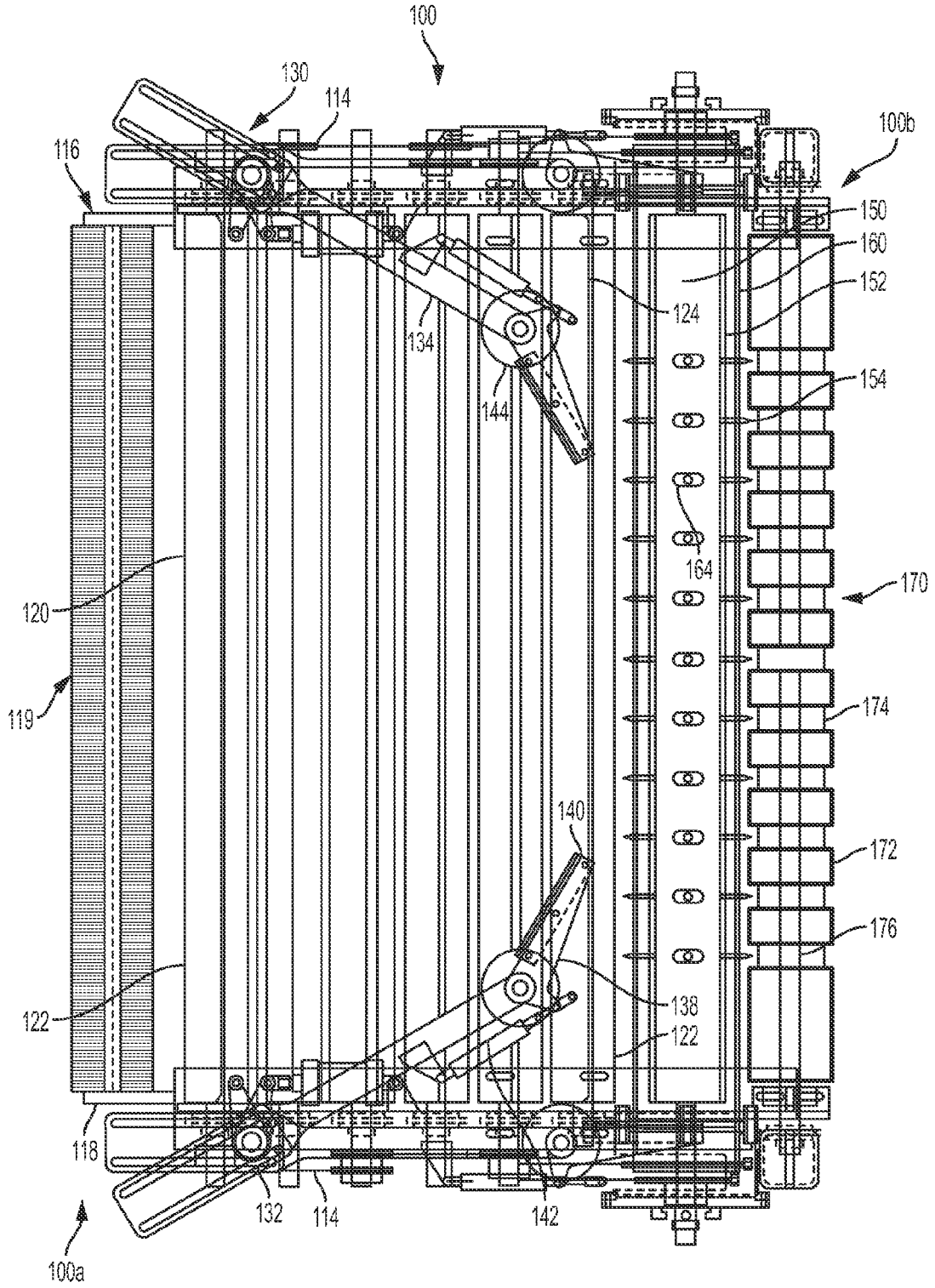
FIG. 3 is a top view of the round cotton module opener as shown in FIG. 2.
Figure 4:
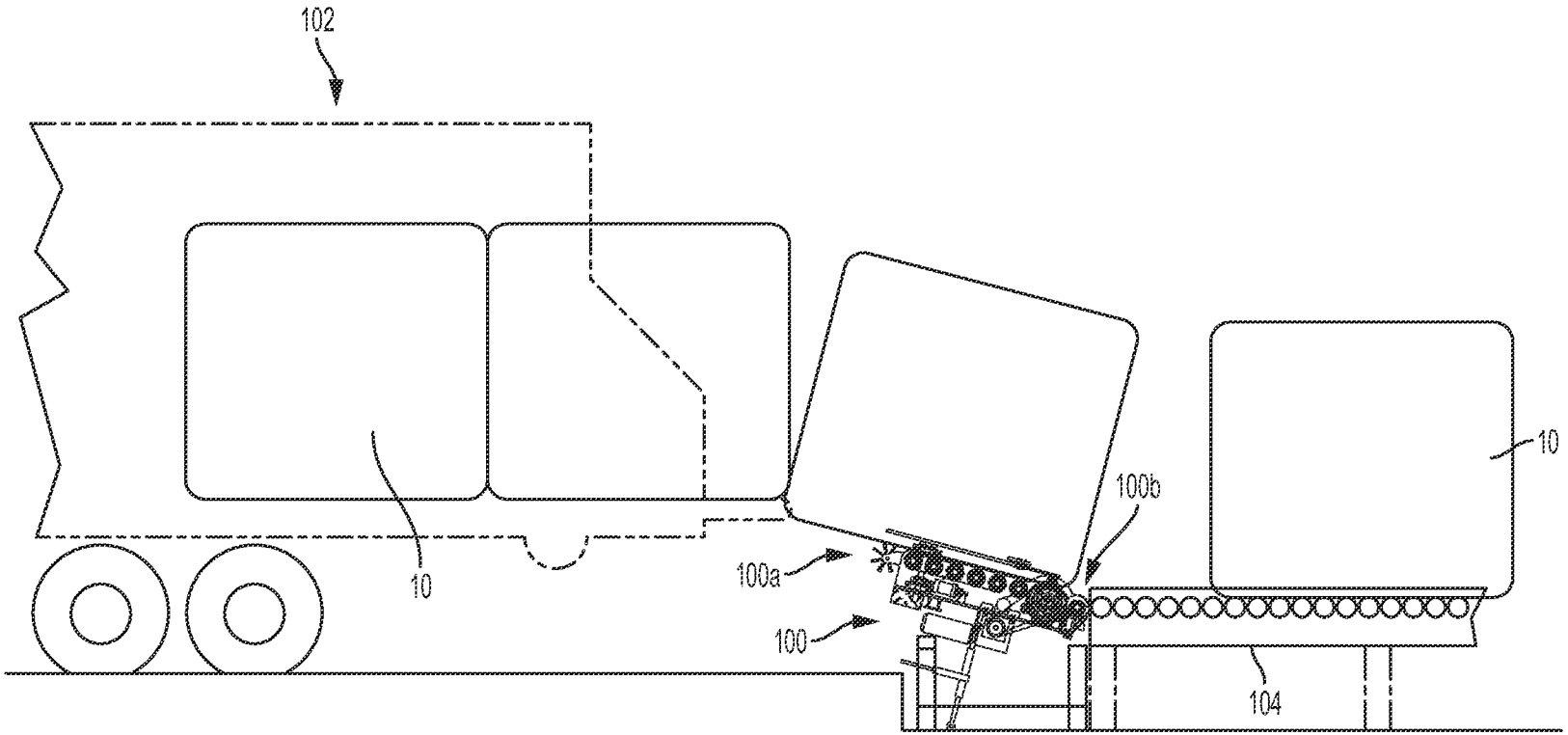
FIG. 4 is a side view of the round cotton module opener as shown in FIG. 2 disposed between a round module mover and a feeder bed of a cotton gin.

Referring now to FIGS. 2 through 4, a round module opener 100 in accordance with an embodiment of the present disclosure is shown. Preferably, round module opener 100 includes a sweeper assembly 116, an unload conveyor assembly 120, a picker assembly 150, and a transfer assembly 170, each of which extends between a pair of side frame members 114 of the module opener's frame assembly 110. Sweeper assembly 116 is pivotably mounted to a first, or upstream, end 100*a* of frame assembly 110. Unload conveyor assembly 120 is mounted between side frame members 114 downstream of sweeper assembly 116 and is configured to move a round cotton module 10 (FIGS. 1A and 1B) along round module opener 110 in a first direction that is parallel to a longitudinal center axis of round module opener 100. Picker assembly 150 is rotatably mounted between side frame members 114 on the downstream end of unload conveyor assembly 120. Picker assembly is configured to remove a bottom portion of a round cotton module's wrap 20 (FIGS. 1A and 1B) that has been previously cut along both sides of the round cotton module by a slitter assembly 130, as discussed in greater detail below. Transfer assembly 170 is rotatably disposed between side frame members 114 at a second, or downstream, end 100*b* of round module opener 100. Transfer assembly 170 is configured to move round cotton modules 100 off of round module opener 100 and onto a feeder bed 104 of a corresponding cotton gin.

Figure 6:
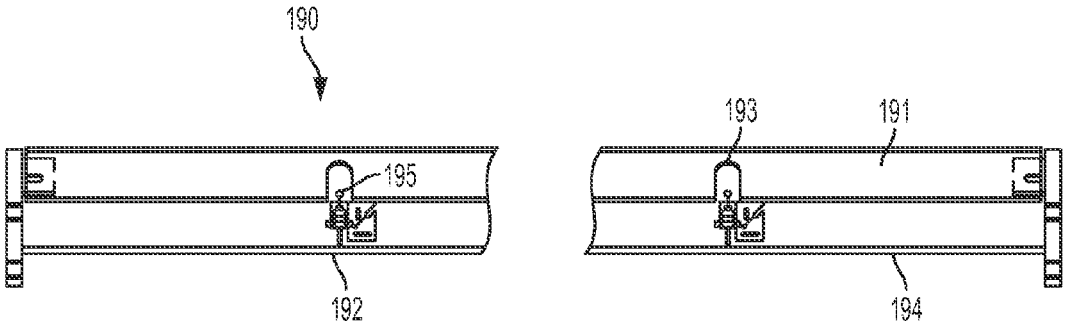
FIG. 6 is a front view of a color sensor assembly of the round cotton module opener as shown in FIG. 2.
Figure 7:
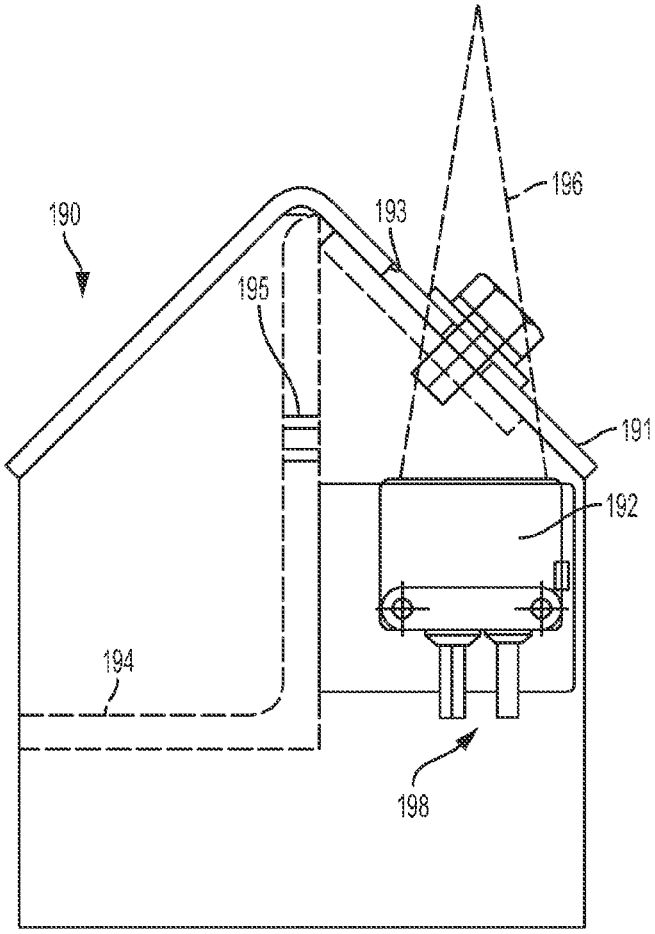
FIG. 7 is a side view of the color sensor assembly as shown in FIG. 6.

Additionally, in the preferred embodiment shown, slitter assembly 130 includes a pair of elongated arms 134, each elongated arm 134 being pivotably secured to a corresponding side frame member 114 such that they oppose each other over unload conveyor assembly 120. Referring additionally to FIGS. 6 and 7, a color sensor assembly 190 extends between side frame members 114 at downstream end 100*b* of round module opener 100. As best seen in FIG. 4, side frame members 114 are pivotably secured to a base 112 of frame assembly 110 so that the height of upstream end 100*a* of round module opener 100 above the floor of the cotton gin can be adjusted to accommodate unloading round cotton modules 10 from module movers, such as truck, having delivery decks of various heights. A ratcheting inclination assembly 115 is utilized to adjust the height of the module opener's upstream end 100*a*.

Sweeper assembly 116 is shown in an extended position in which sweeper assembly 116 engages the bottom surface of each round cotton module's wrap 20 as it is unloaded from module mover 102. Sweeper assembly 116 includes an elongated cylindrical brush 119 that is mounted to side frame members 114 of round module opener 100 by a pivotable frame 118. An air cylinder (not shown) is used to pivot sweeper assembly 116 from the in-use position shown to a retracted position in which cylindrical brush 119 does not make contact with cotton modules as they are being unloaded. For instance, sweeper assembly 116 is placed in the retracted position when rectangular cotton modules are unloaded, as rectangular cotton modules do not include a wrap. However, where a wrap 20 (FIGS. 1A and 1B) is used, such as with round cotton modules 10, it is desirable to remove any dirt, sticks, debris, mud, excess moisture, etc., that may be present on the bottom surface of the wrap. Sweeper assembly 116 is preferably rotated in a direction that is opposite the direction of travel of the round cotton modules. As best seen in FIG. 2, this would mean that cylindrical brush 119 is rotated in the counter-clockwise direction, such that rocks, dirt, and other debris that is removed from the bottom of each wrap 20 is moved away from unload conveyor assembly 120, thereby reducing the chances that the debris will enter the cotton gin.

After the removal of debris from the bottom of wrap 20, each round cotton module 10 is moved onto unload conveyor assembly 120. Unload conveyor assembly 120 preferably includes approximately six feet of unload rollers 122, each unload roller 122 extending between side frame members 114 transversely to the direction of travel of the round cotton modules. Preferably, each unload roller 122 is powered by one or more roller chains 181 that are driven by a motor 180, and various numbers, and diameters, of unload rollers 122 may be used to construct unload conveyor assembly 120. As shown, elongated grip bars 124 are provided on every other unload roller 122. Grip bars 124 extend along the outer surface of the corresponding unload roller 122 in a direction that is parallel to a longitudinal center axis of the powered roller. In alternate embodiments, each unload roller 122 may include a plurality of grip bars 124 disposed on its outer surface. Grip bars 124 provide additional friction between unload rollers 122 and wrap 20 of the corresponding round cotton module 10, thereby facilitating its movement in the first direction on round module opener 100. Additionally, in alternate embodiments, grip bars 124 need not extend the entire length of the corresponding unload rollers.

In the preferred embodiment shown, each elongated arm 134 of slitter assembly 130 is pivotably mounted above a corresponding side frame member 114 by a vertical post 132. Each elongated arm 134 is pivotable between an in-use position in which it extends outwardly over unload conveyor assembly 120, as shown in FIG. 3, and a retracted position in which each elongated arm 134 is disposed above and parallel to its corresponding side frame member 114. Each elongated arm is preferably rotated between the two positions by a corresponding air cylinder 136. Note, however, in alternate embodiments hydraulic cylinders may be used rather than air cylinders. A knife holder 138 including a replaceable elongated knife blade 140 is pivotably mounted to the distal end of a corresponding elongated arm 134. An air cylinder 142 is secured to each knife holder 138 and its corresponding elongated arm 134 so that the angle of inclination of each knife blade 140 relative to its corresponding elongated arm 134 may be adjusted. In so doing, air cylinders 142 also help determine the extent to which the knife blades 140 slice into the corresponding round cotton module 10 after slicing through wrap 20. A gauge wheel 144 is mounted to each slitter arm at the point where each knife holder 138 is pivotably secured to the corresponding elongated arm 134. Gauge wheels 144 make contact with the cylindrical side surfaces 14 of the corresponding round cotton module 10 as it passes between the elongated arms, thereby also limiting the overall extent to which each knife blade 140 is able to penetrate the corresponding round cotton module. Referring additionally to FIGS. 1A and 1B, the angle of inclination of knife blades 140 relative to the corresponding elongated arms 134 is selected such that each knife blade is able to slice through the corresponding front lip 22 of wrap 20, yet not slice deeper than is necessary to slit wrap 20 along its entire length as it passes along unload conveyor assembly 120.

Figure 5:
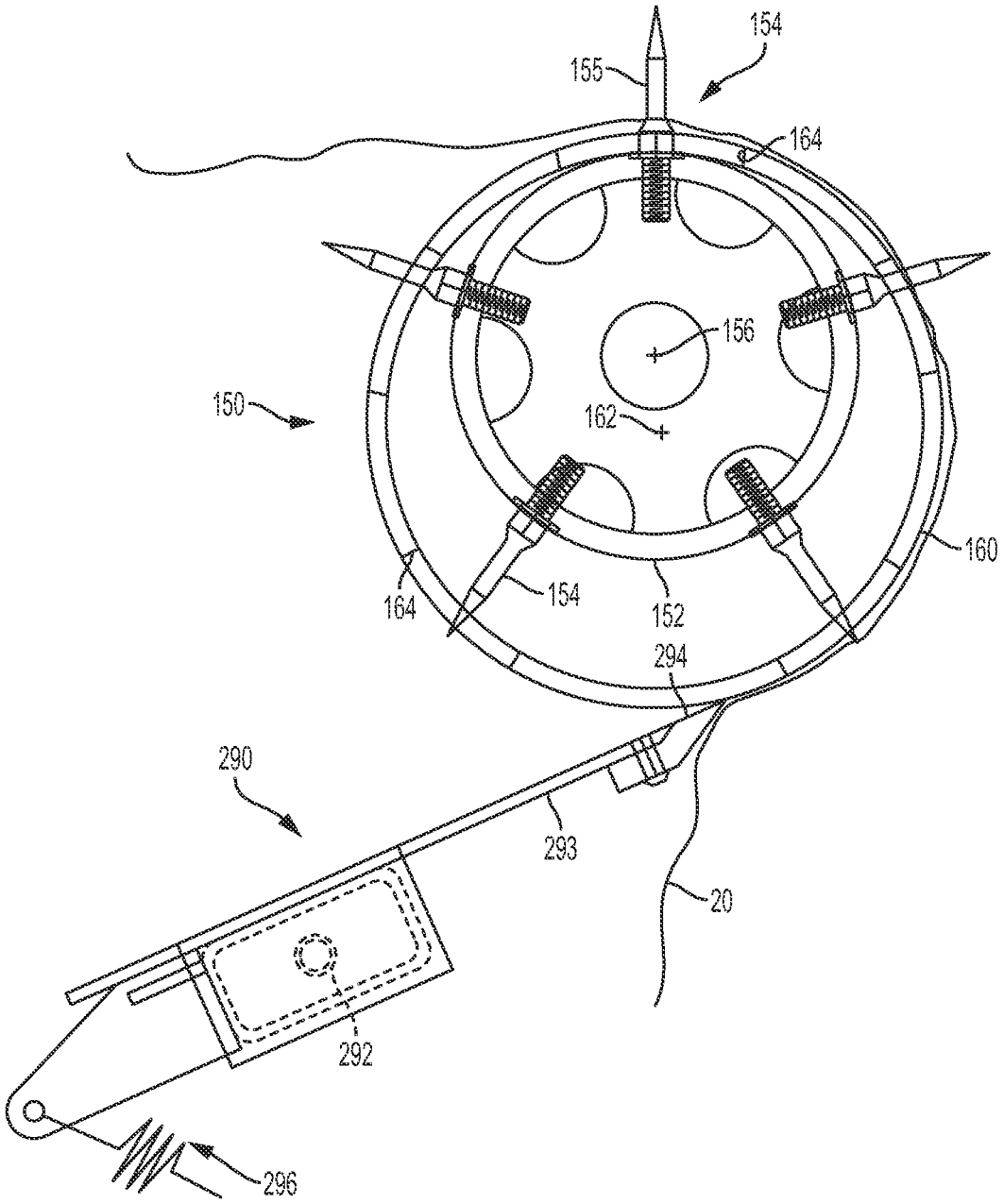
FIG. 5 is a cross-sectional view of an alternate embodiment of a picker assembly of the round cotton module opener including a scraper assembly.

Referring to FIGS. 2 and 3, picker assembly 150 extends between side frame members 114 such that it is transverse to the direction of travel of the round cotton modules. As best seen in FIG. 5, picker assembly 150 includes an inner cylinder 152 that is disposed within an outer cylinder 160, inner cylinder including a plurality of spikes 154 that extend radially outwardly therefrom. As shown, spikes 154 are mounted circumferentially on inner cylinder 152 on six (6) equally spaced positions and longitudinally on inner cylinder 152 at equally-spaced intervals. Note, however, that fewer or more rows of equally-spaced spikes can be used. For example, in an alternative embodiment shown in FIG. 5, five (5) equally-spaced rows of spikes 154 are used. Still referring to FIG. 5, outer cylinder 160 includes a plurality of slots 164, each slot corresponding to a position of a spike 154 on inner cylinder 152. The longitudinal center axis 156 of inner cylinder is offset from the longitudinal center axis 162 of outer cylinder 160 such that as inner cylinder 152 and outer cylinder 160 rotate simultaneously at the same speed, each spike 154 alternately extends outwardly from, and is retracted inwardly into, its corresponding slot 164. As shown in FIG. 5, longitudinal center axis 156 of inner cylinder 152 is disposed above longitudinal center axis 162 of outer cylinder 160 such that each spike begins to protrude from its corresponding slot 164 at approximately the 8 o'clock position. Continued rotation of inner cylinder 152 and outer cylinder 160 causes each spike 154 to fully protrude through its corresponding slot 164 in the 12 o'clock position, and once again be fully retracted at the 4 o'clock position.

Rotation of picker assembly 150 in the clockwise direction causes spikes 154 to pierce the bottom portion of wrap 20 which has been previously separated from the remainder of the corresponding wrap 20 by slitter assembly 130. Once spikes 154, such as those shown in the 12 o'clock position, have pierced the bottom portion of the wrap, continued rotation of picker assembly 150 pulls the bottom portion of the wrap downward and away from the bottom of the corresponding round cotton module 10. As picker assembly 150 continues to rotate in the clockwise direction, spikes 154 moving between the 12 o'clock and 4 o'clock positions begin to retract into outer cylinder 160 such that the bottom portion of the wrap is stripped away from the spikes 154, thereby allowing the bottom portion of the wrap to fall to the floor of the cotton gin.

Preferably, each spike 154 includes a sharp distal point at an angle of approximately 20° to 30° to minimize the amount of force required to pierce each wrap 20, which may include up to nine layers of plastic. Each spike 154 widens towards a cylindrical body portion 155 such that the wrap 20 is readily removed from the spikes 154 as they are retracted through their corresponding slots 164 into outer cylinder 160. As best seen in FIG. 2, a take-up frame 158 is provided that support both inner cylinder 152 and outer cylinder 160 at their outermost ends and allows the distance between longitudinal center axis 156 of inner cylinder 152 and longitudinal center axis 162 of outer cylinder 160 to be adjusted radially. Specifically, referring additionally to FIG. 10, an air cylinder 159 is used to slide an inner frame member 161, to which inner cylinder 152 is rotatably secured, both upwardly and downwardly within a vertical channel 163 that is defined by an outer frame member 165, to which outer cylinder 160 is rotatably secured. As such, air cylinder 159 can move inner cylinder 152 both upwardly and downwardly relative to outer cylinder 160 as desired. Correspondingly, the points at which each spike 154 begins to extend from and retract into its corresponding slot 164 is adjusted. The distance between the longitudinal center axes determines the depth to which each spike 154 penetrates the corresponding wrap 20 when in the 12 o'clock position. In the lowermost position of inner cylinder 152 relative to outer cylinder 160, spikes 154 that are in the 12 o'clock position are fully retracted within outer cylinder 160. This allows "standard", or square modules, which do not include wraps to be unloaded. As well, persons working on the round module opener 100 are now free to walk across the picker assembly 150 outer roller 160 as may be necessary during operations.

As best seen in FIG. 5, a scraper assembly 290 is preferably provided under picker assembly 150 along its entire length and is pivotably mounted to the frame at a pivot point 292. A first end of scraper assembly 290 includes a plurality of scraper blades 293, each scraper blade 294 being disposed between adjacent rows of spikes 154 of picker assembly 150. Each scraper blade 293 includes a replaceable scraper tip 294 that is in contact with the outer surface of the picker assembly's outer cylinder 160. Scraper tips 294 are preferably comprised of a phenolic material. A second end of scraper assembly 290 includes one or more tension springs 296 that bias the first end of the scraper assembly and, therefore, the plurality of scraper blades 294 into contact with the outer surface of the picker assembly's outer roller 160. As such, scraper blades 294 help separate wraps 20 that are removed from the round modules 10 from picker assembly 150.

Figure 10:
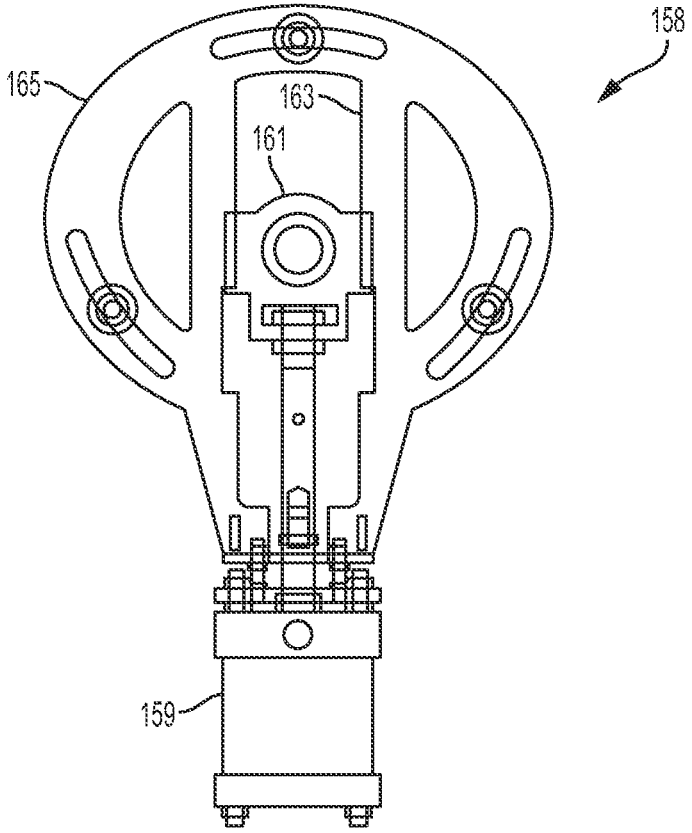
FIG. 10 is a detailed side view of the take-up frame as shown in FIG. 2.
Figure 11:
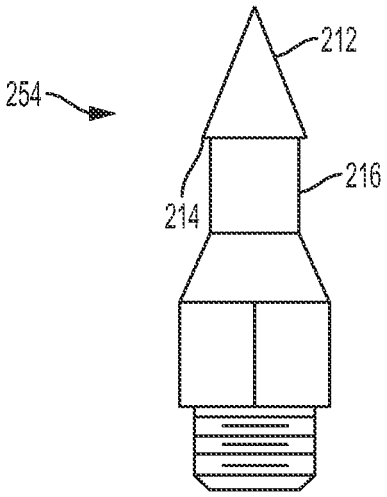
FIG. 11 is a side view of an alternate spike shape for use with the picker assembly shown in FIGS. 2 and 3.

Referring now to FIG. 10, in an alternate embodiment each spike 254 is designed with a sharp point 212 at an included angle of 20° to 30° to minimize the puncture force required to pierce nine (9) layers of plastic wrap at once. Point 212 is arrow head shaped to insure that the wrap remains on each spike 254 after it is punctured. A base 214 of each point 212 is angled opposite to point 212 thus lowering the stripping force to remove the wrap. A cylindrical shank 216 is of sufficient diameter to prevent the plastic from shrinking so far that it increases stripping forces.

As best seen in FIG. 3, transfer assembly 170 includes a plurality of driven roller portions 172 that are alternatingly spaced along the longitudinal center axis with a plurality of free roller portions 174 along the longitudinal center axis of the transfer assembly's elongated shaft 176. Driven roller portions 172 are keyed to elongated shaft 176 such that they rotate in the same direction as the shaft. However, free roller portions 174 are not keyed to elongated shaft 176 and are therefore free to rotate in either the same direction as elongated shaft 176 or the opposite direction. Driven roller portions 172 are rotated by a 3-horsepower gear motor (not shown), Part No. QTN347352B33D634182TC, available from Emerson Power Transmission, in the direction of travel of the round cotton modules 10 to facilitate movement of each unwrapped module off of round module opener 100 and onto feeder bed 104 of the cotton gin. The speed of the gear motor is controlled by an adjustable frequency drive. Preferably, driven roller portions 172 are rotated independently of picker assembly 150, which is rotated by a motor 180, as best seen in FIG. 2. Operating driven roller portions 172 of transfer assembly 170 independently of picker assembly 150 facilitates the clearing of cotton buildup which may occur between transfer assembly 170 and picker assembly 150 by rotating transfer assembly 170 in a direction opposite to the normal direction of travel of the round cotton modules. This action also redirects plastic wrap 20 between picker assembly 150 and transfer assembly 170, as shown in FIG. 5. To facilitate plastic wrap removal, a beam sensor (not shown) detects the front of each round module 10, and rotates drive roller portions 172 in the reverse direction, at the same speed as picker assembly 150, to redirect the lead edge of the wrap, as noted. After the wrap has been redirected, rotation of the driven roller portions 172 in the forward direction is then resumed. Specifically, upon resuming rotation in the forward direction, driven roller portions 172 are rotated at approximately twice the speed at which picker assembly 150 is rotated, for approximately 4 seconds. This period of higher speed rotation helps to pull any cotton that has been entrained downwardly with the front edge of the wrap back up from between picker assembly 150 and transfer assembly 170 onto the feeder bed. In alternate embodiments, transfer assembly 170 may also be driven by motor 180 rather than its individual motor.

As shown, the diameter of each driven roller portion 172 is greater than the diameter of each free roller portion 174, with the circumferential rows of spikes 154 on picker assembly 150 being aligned with a corresponding row of the free roller portions 174. Because free roller portions 174 are free to rotate in either the clockwise or counter-clockwise directions about elongated shaft 176, should portions of the wrap or excess cotton begin to build up between picker assembly 150 and transfer assembly 170, rotation of the free roller portions 174 in the counter-clockwise direction facilitates clearing of the built-up matter. Motor 180 is preferably a standard right angle gear box with a 7.5-horsepower drive motor. An example motor 180 is Part No. QTN347352P3340T24213T7.5 available from Emerson Power Transmission. The speed of motor 180 is controlled by an adjustable frequency drive and, therefore, it can be matched with the speed at which round cotton modules 10 are delivered by the module mover 102, as well as the speed of the feeder bed 104 of the gin. Motor 180 is reversible to facilitate clearing any buildup of cotton or portions of wrap 20 that may become clogged between various components of round module opener 100.

Referring additionally to FIGS. 6 and 7, color sensor assembly 190 is mounted between side frame members 114 on the downstream side of transfer assembly 170. As shown, color sensor assembly 190 includes a transverse frame member 194, a plurality of color sensors 192 mounted thereto beneath an elongated hood portion 191 that extends the length of transverse frame member 194. The color sensors 192 used in the preferred embodiment are available from Keyence Corp., Part No. CZ-VZ21AP, Smart RGB Digital Sensor. A plurality or apertures 193 is defined in hood 191, each aperture 193 being disposed above a corresponding color sensor 192. Hood 191 is angled downwardly such that any cotton that may fall on color sensor assembly 190 tends to fall to the floor of the gin rather than building up on top of color sensor assembly 190. However, to further prevent the buildup of cotton on color sensor assembly 190, an air jet 195 is provided for each color sensor 192 and is activated at intervals to blow any loose cotton off of the corresponding color sensor 192.

In operation, a sensor beam 196 passes upwardly through the corresponding aperture 193 on hood 191 and onto the bottom of a corresponding round cotton module 10 as it exists round module opener 100 and passes on to feeder bed 104 of the gin. Color sensors 192 are programmed to detect the presence of various colors that are typically used for the wraps 20 that are disposed around the round cotton modules. For example, typical colors used for the wraps are yellow, pink, white, blue, and tan. The detection of any of these colors on the bottom of a corresponding round cotton module 10 indicates that a portion of the wrap 20 that was thought to have been previously removed may still be present on the bottom of the round cotton module. Preferably, detection of these colors by color sensor assembly 190 activates an alarm that allows the corresponding round cotton module 10 to be stopped so that the remaining wrap 20 may be removed prior to the round cotton module 10 being fed into the gin. As such, color sensor assembly 190 aids in preventing the contamination of the cotton that is being processed in the gin with plastic.

Figure 8:
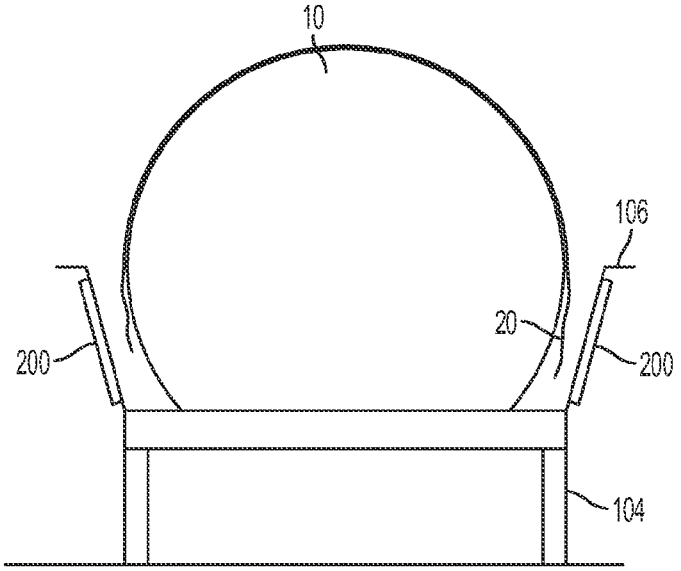
FIG. 8 is an end view of a feeder bed of a cotton gin including a color sensor assembly.
Figure 9:
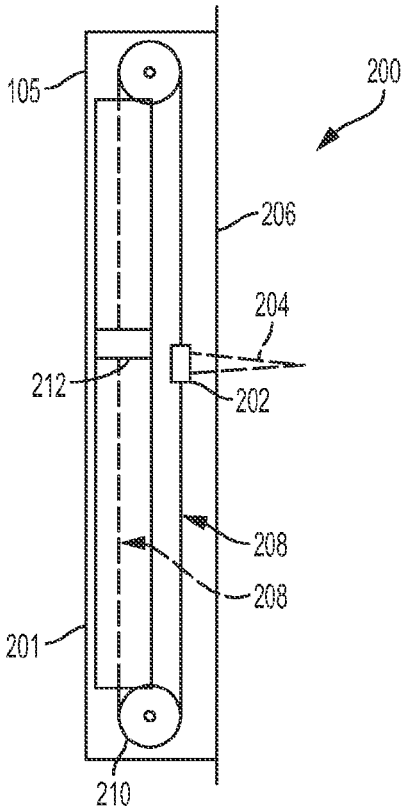
FIG. 9 is a detailed side view of the color sensor assembly as shown in FIG. 8.

Referring now to FIGS. 8 and 9, an alternate embodiment of a color sensor assembly 200 is shown. Preferably, color sensor assembly 200 includes a color sensor 202 that is disposed on a cable 208 that extends between two pulleys 210. A piston 212 is also disposed on cable 208 and facilitates movement of cable 208 about pulleys 210 such that color sensor 202 may be moved upwardly and downwardly within its corresponding housing 201. The piston drive system is available from Tol-O-Matic, Part No. CC05. This allows a single sensor 202 to be positioned on a corresponding side wall 105 of the gin's feeder bed 104 and be alternatingly moved upwardly and downwardly as each round cotton module 10 passes by. As such, a single color sensor may scan a large portion of each cotton module. As shown, a color sensor assembly 200 is disposed on each side wall 105 of feeder bed 104 for the detection of any wrap 20 that may be present. Preferably, housing 201 includes a clear window 206 disposed over color sensor 202 to prevent cotton from building up within the color sensor assembly, thereby reducing its effectiveness. In alternate embodiments, various drive systems may be used to move color sensor 202 vertically up and down, such as, but not limited to, rack and pinion drives, magnetic linear slides, etc. As well, in alternate embodiments, multiple stationary color sensors 202 may be used rather than the single movable sensor that is shown.

While one or more preferred embodiments of the invention are described above, it should be appreciated by those skilled in the art that various modifications and variations can be made in the present invention without departing from the scope and spirit thereof.

What is claimed:

1. A round module opener for use with a round module of cotton that is disposed within a wrap, comprising:

a frame;

an unload conveyor assembly that is rotatably supported by the frame so that rotation of the unload conveyor assembly moves the round module of cotton in a first direction from a first end to a second end of the round module opener, the first direction being parallel to a longitudinal center axis of the round module opener;

a slitter assembly that is secured to the frame and positionable so that the slitter assembly slices through the wrap along its entire length as the round module of cotton moves from the first end to the second end of the round module opener;

a picker assembly including a plurality of projections, the picker assembly being adjacent the unload conveyor assembly and rotated relative to the frame so that the plurality of projections first pierce a first portion of the wrap and are subsequently withdrawn from the first portion of the wrap, thereby separating the first portion of the wrap from the round cotton module; and a sensor assembly including at least one color sensor disposed on the frame between the picker assembly and the second end of the round module opener so that the color sensor of the sensor assembly detects the presence of the first portion of the wrap as the round cotton module is moved off the second end of the round module opener by determining a color of the wrap.

2. The round module opener of claim 1, wherein the unload conveyor assembly includes a plurality of unload rollers, each unload roller having a longitudinal center axis that is traverse to the longitudinal center axis of the round module opener.

3. The round module opener of claim 1, further comprising a transfer assembly disposed adjacent the picker assembly, wherein the transfer assembly comprises a plurality of powered roller segments so that rotation of the powered roller segments moves the round cotton module in the first direction and off of the round module opener.

4. The round module opener of claim 3, wherein the transfer assembly further comprises a plurality of free roller segments that are free to rotate in either direction relative to the powered roller segments, wherein the powered roller segments and the free roller segments are alternatingly positioned along the transfer assembly.

5. The round module opener of claim 1, wherein the slitter assembly further comprises a pair of slitter arms, the slitter arms being pivotably mounted to the frame on opposing sides of the unload conveyor assembly, each slitter arm including a distal end that is pivotable inwardly toward the longitudinal center axis of the round module opener so that it contacts and cuts the wrapper of the round cotton module as it moves in the first direction on the unload conveyor assembly.

6. A round module opener for use with a round module of cotton that is disposed within a wrap, comprising:

a frame;

an unload conveyor assembly that is rotatably supported by the frame so that rotation of the unload conveyor assembly moves the round module of cotton in a first direction from a first end to a second end of the round module opener, the first direction being parallel to a longitudinal center axis of the round module opener;

a slitter assembly that is secured to the frame and positionable so that the slitter assembly slices through the wrap along its entire length as the round module of cotton moves from the first end to the second end of the round module opener;

a picker assembly that is adjacent the unload conveyor assembly on a downstream side of the slitter assembly so that the picker assembly engages a first portion of the wrap and separates the first portion of the wrap from the round cotton module;

a transfer assembly disposed adjacent the picker assembly, the transfer assembly comprising at least one powered roller segment that is rotatable in a first direction and a second direction that is opposite the first direction, rotation of the at least one powered roller segment in the first direction moving the round cotton module in the first direction and off of the round module opener, and a plurality of free roller segments that are free to rotate in both the first direction and the second direction relative to the powered roller segments, the powered roller segments and the free roller segments being alternatingly positioned along the transfer assembly, wherein an outermost diameter of each powered roller segment is greater than an outermost diameter of each free roller segment, and each projection of the picker assembly is aligned with a corresponding one of the free roller segments.

7. The round module opener of claim 6, wherein the at least one powered roller segment of the transfer assembly comprises a plurality of powered roller segments and the picker assembly further comprises a first plurality of projections extending radially from a roller so that as the roller of the picker assembly is rotated in the first direction. the plurality of projections first pierce the first portion of the wrap and are subsequently withdrawn from the first portion of the wrap.

8. The round module opener of claim 6, wherein the unload conveyor assembly includes a plurality of unload rollers, each unload roller having a longitudinal center axis that is traverse to the longitudinal center axis of the round module opener.

9. The round module opener of claim 6, further comprising a sensor assembly disposed on the frame of the module opener on the downstream side of the picker assembly so that the sensor assembly detects the presence of the first portion of the wrap as the round cotton module is moved off the second end of the round module opener.

10. The round module opener of claim 9, wherein the sensor assembly further comprises at least one color sensor so that the presence of the first portion of the wrap is determined by detecting its color.

11. A round module opener for use with a round module of cotton that is disposed within a wrap, comprising:

a frame;

an unload conveyor assembly that is rotatably supported by the frame so that rotation of the unload conveyor assembly moves the round module of cotton in a first direction from a first end to a second end of the round module opener, the first direction being parallel to a longitudinal center axis of the round module opener;

a slitter assembly that is secured to the frame and positionable so that the slitter assembly slices through the wrap along its entire length as the round module of cotton moves from the first end to the second end of the round module opener; and a picker assembly including an inner cylinder including a plurality of projections and an outer cylinder, the inner cylinder being disposed inside the outer cylinder so that at least a portion of the projections extend outwardly through the outer cylinder, wherein the picker assembly is adjacent the unload conveyor assembly and rotatable relative to the frame so that the plurality of projections first pierce a first portion of the wrap and are subsequently withdrawn from the first portion of the wrap, thereby separating the first portion of the wrap from the round cotton module;

and a sensor assembly including at least one color sensor disposed on the frame between the picker assembly and the second end of the round module opener so that the at least one color sensor of the sensor assembly detects the presence of the first portion of the wrap as the round cotton module is moved off the second end of the round module opener by detecting a color of the wrap.

12. The round module opener of claim 11, wherein a longitudinal center axis of the inner cylinder is parallel to a longitudinal center axis of the outer cylinder and spaced apart therefrom.

13. The round module opener of claim 11, wherein the outer cylinder further comprises a plurality of slots formed therein and each of the plurality of projections is selectively extendable through a corresponding one of the plurality of slots.

14. The round module opener of claim 11, further comprising a transfer assembly disposed adjacent the picker assembly, wherein the transfer assembly comprises a plurality of powered roller segments so that rotation of the powered roller segments moves the round cotton module in the first direction and off of the round module opener.

* * * * *